US006563410B1

(12) United States Patent
Marton

(10) Patent No.: US 6,563,410 B1
(45) Date of Patent: May 13, 2003

(54) SMALL FOOTPRINT POWER TRANSFORMER INCORPORATING IMPROVED HEAT DISSIPATION MEANS

(76) Inventor: Louis L. Marton, 1327 Berkeley St., No. 2, Santa Monica, CA (US) 90404-2529

( * ) Notice: Subject to any disclaimer, the term of this patent is extended or adjusted under 35 U.S.C. 154(b) by 0 days.

(21) Appl. No.: 09/715,784

(22) Filed: Nov. 16, 2000

(51) Int. Cl.[7] ..... H01F 27/08

(52) U.S. Cl. ..... 336/55; 336/57; 336/58; 336/59; 336/60; 336/61

(58) Field of Search ..... 336/55, 57, 58, 336/59, 60, 61, 69, 70

(56) References Cited

U.S. PATENT DOCUMENTS 3,659,239 A 4/1972 Marton ..... 336/57

*Primary Examiner*—Elvin Enad
*Assistant Examiner*—Jennifer A. Poker

(57) ABSTRACT

A small footprint power transformer constructed so as to exhibit improved heat dissipation characteristics and an enhanced flow of a cooling medium. The transformer construction achieves small footprint by superimposing the core legs with the windings in vertical relationship. Highly heat conductive plane dissipators are inserted between adjacent finished coil discs and extended beyond the winding structure, terminating in fins arranged to assure maximum heat transfer to a cooling medium flowing therepast resulting in substantial reduction of the temperature rise.

16 Claims, 8 Drawing Sheets

SMALL FOOTPRINT POWER TRANSFORMER INCORPORATING IMPROVED HEAT DISSIPATION MEANS

CROSS-REFERENCE TO RELATED APPLICATIONS

Not Applicable

BACKGROUND FIELD OF INVENTION

This invention relates generally to small footprint transformers equipped with heat dissipators and, more particularly, to improved transformer constructions adapted to the more efficient cooling arrangements for dissipating heat generated in the winding structure of power transformers.

BACKGROUND DISCUSSION OF PRIOR ART

Transformers, as most electric apparatus and equipment, do not have specific rating: their load carrying capacity is limited only by their temperature. In transformer windings, due to their resistance, losses are generated proportionally to the square of the load currents and eddy currents, warming up the windings. Their temperature, however, depends on the efficiency of the cooling arrangement used for removing the generated losses.

In the present practice, natural convection plays the largest role in cooling via the surface of the winding. Tubular windings are in use almost exclusively. If the outside surface of the winding does not provide sufficient heat transfer, the present practice is to create cooling ducts between winding layers by separating the layers with spacers. These ducts are not very efficient, because the cooling medium moves slowly in narrow spaces, and warms up considerably before finally exits at the top of the duct. Consequently, the temperature at the top portion of the winding is much higher than at the bottom portion.

Including wider ducts increases the mean turn length of the winding. Thus the weight of the winding also increases, and the losses. Using longer core legs and longer windings to increase the cooling surface, but the losses further increase. Deviating the configuration more from the optimum format, the toroid—which has the minimum material content, but inferior cooling surfaces for natural convection creates this increase. Generally, a large part of the gain expected from enlarging the cooling surfaces of the winding is canceled by increased weight and losses.

Several attempts are documented in the prior art to improve the cooling process by including highly heat conductive metal sheets into windings. None of the prior art uses a dissipator displaying features of the present invention and achieves significant improvement except one: U.S. Pat. No. 3,659,239 to Marton, Apr. 25, 1972. This patent, however, limits the use of heat dissipators to tubular layer-wound winding structures mounted on vertical core legs. The layers of the windings are interleaved with contiguous portions of dissipators wound into the windings alternating with the winding layers. A louver-like structure is prefabricated on an extended portion of the dissipator sheets, and arranged outside the winding. The louver-like structures are cut into segments containing a group of fins. The segments are bent into horizontal position disposed in planes at both ends of each layer. The segments build up several levels of fins. The major surfaces of the fins are oriented close to vertical. With this orientation the channels are wide, and the resistance to the flow of the cooling medium is small.

With the heat dissipators in this configuration, substantial improvement can be achieved: Keeping the costs and materials the same, the winding losses and temperature rise can be reduced. These values are less than half of the conventional values. Keeping the same losses, 30% winding material, and 12% core steel can be saved with 15% less temperature rise.

Between 1968 and 1976, four small companies in a row manufactured about 3000 units with tubular heat dissipators according to this patent. These units are still in flawless operation. This small scale production has been discontinued only because of lack of interest in energy saving, lack of honest cooperation between partners, unfair competition, and lack of adequate working capital.

During the elapsed 32 years, this technology has been offered five times to every U.S. transformer manufacturer. All of them rejected it. In 1978, it was submitted to the invention evaluation program sponsored by the U.S. Department of Energy. Two independent engineering companies evaluated it with positive recommendations. In 1980, the Department of Energy still refused to offer meaningful support. Thus, in the past twenty-five years, the substantial improvements introduced by this technology remain unused.

All present transformer production uses the conventional 100-year-old technology.

This presently unused technology of U.S. Pat. No. 3,659,239 uses layer-wound tubular windings with wound-in heat dissipators. It has several drawbacks. Some of the drawbacks emerge in the production. In this process the dissipators are incorporated into the winding structure at the winding operation. First, the dissipator sheet is bent to follow the curvature of the designated winding layer, wrapped in the proper insulating sheet and placed over the layer. After securing the heat dissipator in its correct position, the next layer is wound over it. Special attention is required to wind very tightly to eliminate any gaps between the layers and the dissipators to keep the internal temperature gradient low. Winding tightly is a slow process.

Tubular winding structures generate leakage flux inside windings; this flux is oriented parallel to the axis of core legs. This flux orientation makes heat dissipator application very difficult when the winding is built up from discs. In flat contiguous dissipators, heavy eddy-currents would develop. To prevent this problem by splitting up the inserted portion of the dissipator into narrow sections, the tooling becomes prohibitively expensive, and the assembly gets complicated. Furthermore, the method described in the prior art cannot be used with dissipators having longer fins. The contour of the windings has a large variety of curvatures, and a separate tool would be required for every different curvature. Thus, the application of heat dissipators in tubular windings built up from discs is limited to short fins, usable only in liquid cooling. Considering the expensive tooling costs and the additional labor costs this version requires, dissipator cooling for discs in tubular winding systems is not economical.

Further drawbacks in layer wound windings become apparent after removing the completed winding from the winding machine. The several levels of louver-like structures on the curved extensions are hand-cut into uneven smaller segments. This type of subdivision is necessary to allow the 90 degree outward bending of the cut-up irregular fin groups. The cut up segments are bent into their final horizontal radial position. Several levels are built up on both ends of the vertical tubular winding.

The combined work of tight winding, dissipator implantation, and the subsequent cutting and bending operations of the dissipators require additional skilled labor time and extra care. Due to the uneven hand-cutting of the bent louver-like structure, the finished transformers don't have a smooth professional appearance. This aspect tends to diminish the acceptability of the product for some customers.

Another shortcoming emerged in the practice. When during assembly or cleaning, the fin segments have been bent up and down three times, they have the tendency to break off. This failure can be remedied only by replacing the winding. After impregnation, there is no remedy possible.

When building transformers with higher kVA rating, the efficiency of the dissipator arrangement diminishes. This occurs due to larger internal temperature gradients developing along the longer layers. There is difficulty of accommodating more levels of louver-like structures crowding at both ends of the windings. This difficulty can be alleviated by assigning extra space along the leg for the louver-like structures. This can be done by interrupting the winding, subdividing it into sections. This solution leads to longer legs, thus heavier units andincreased losses. If the interruption is applied only to the upper layers, some of the louver-like structures have to be cut into segments and bent up on the winding machine. Continuing the winding with the bent-up segments may cause injury to the fin segments, or to the winder.

The subdivided arrangement leads to a larger number of fin segment levels. The cooling gradually diminishes on each subsequent higher level. The upward moving flow gets more and more preheated. To avoid the building up of peaks in the temperature of the winding, more heat dissipators need to be added to sections on higher levels.

In larger transformers, where winding must be subdivided into two or more sections along the vertical core leg, the effect of preheated cooling medium and longer legs is more and more pronounced. In addition, the connections of the multiple segments of the windings become difficult to accommodate in the limited space left open by the fin segments. Ultimately, these difficulties limit the size of the units that is economically feasible with dissipator-cooled layer-wound windings presented in the prior art.

SUMMARY

The present invention offers methods for building transformers with the following substantial improvements:

(1) Compared to the transformer technology presently in general use:

(1.1) Building for standard specification, production costs can be reduced up to 40%, (1.2) As an alternative, keeping the same production costs, the losses and the temperature rise can be reduced by close to 60%.

(1.3) All units have reduced floor space requirement.

(2) Compared to the only relevant, but presently unused prior art:

(2.1) The production is simpler: it requires less time and less skilled labor, thus it reduces production costs.

(2.2) The difference between average and peak temperatures is reduced to a few degrees.

(2.3) The lower peak temperature leads to higher rating with the same active material content.

(2.4) All units have reduced floor space requirement.

(2.5) There is no size limit for the application of the new technology.

(2.6) Any cooling medium (air, SF6, oil, etc.) can be used.

(2.7) All units have well organized, attractive appearance.

OBJECTS AND ADVANTAGES

In view of the foregoing, several objects and advantages of the present invention are outlined in the following paragraphs.

Winding structures on transformer legs are superimposed, one over the other. This configuration coupled with close to square windows leads to smaller floor space requirement.

Its winding structure can be assembled using a number of identical disc coils. These discs can be produced using multiple winding techniques and saving labor time and production costs. No dissipators are involved in the winding operation.

It applies plane dissipators inserted at the end of the assembly operation into the discs. This procedure is simple and quick.

The plane dissipators have unobstructed access to fresh cooling medium. Thus, the peak temperature of the winding is close to the average, leading to higher ratings for units with the same active material content.

The ratings of the transformers have no limitations. The disc coils with or without dissipators can be built for any rating with no problems.

The disc coils with or without dissipators can be built for any cooling medium (air, SF6, oil, etc.). The dimensions of the fins need to be adapted to the convection potential of the selected medium.

The coils line up on the core leg with their inserted dissipators in a row having the same dimensions; they offer a well organized, attractive appearance.

The invention achieves one of its objects by offering the possibility of building transformers with windings composed of identical disc coils. These disc coils can be multiple wound between flanges on the same machine, saving labor time. There is no need for tight winding: no heat travels between layers. Subsequently, the coils can be impregnated without removing them from the mandrel. The solid disc coils can be easily and safely assembled on a core tube.

The invention achieves its additional objects by applying louver-like heat transfer surfaces between the plane heat dissipator and the cooling medium. The louver-like heat transfer surfaces of the plane dissipators are contiguous extended portions of the sheet. The first step is splitting the extended portion into fins. Next, each fin is spaced apart of its original position by a selected amount of displacement and/or rotation in the fabricating process. These plane dissipators placed between disc coils at the assembly operation without any change. There is no need for hand-cutting into fin segments. There is no bending, and no chance of breaking off by repeated bending.

The invention further achieves its objects by building up the winding from a multiplicity of disc-like coils with relatively short radial dimension. Thus the heat, picked up by the dissipator, travels only along its short radial dimension before reaches the louver structure. This arrangement leads to minimum internal temperature gradient. The leakage flux also oriented in radial direction between the primary and secondary windings. Since both the dissipators and the leakage flux have radial orientation, there is no interference between them.

The invention further achieves its objects by offering a way to build transformers for larger kVA ratings with a larger number of discs. These discs have a larger circumference, without a significant increase of the radial dimension. Consequently more and longer dissipators can be interleaved with the larger discs without diminishing the efficiency of the heat flow. There is no size limit for the application of the new technology.

This feature is especially pronounced when the discs are arranged on a horizontal core leg and interleaved with vertical plane dissipators. In this arrangement every part of the winding has access to fresh non-preheated cooling medium minimizing the temperature peaks in the winding.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
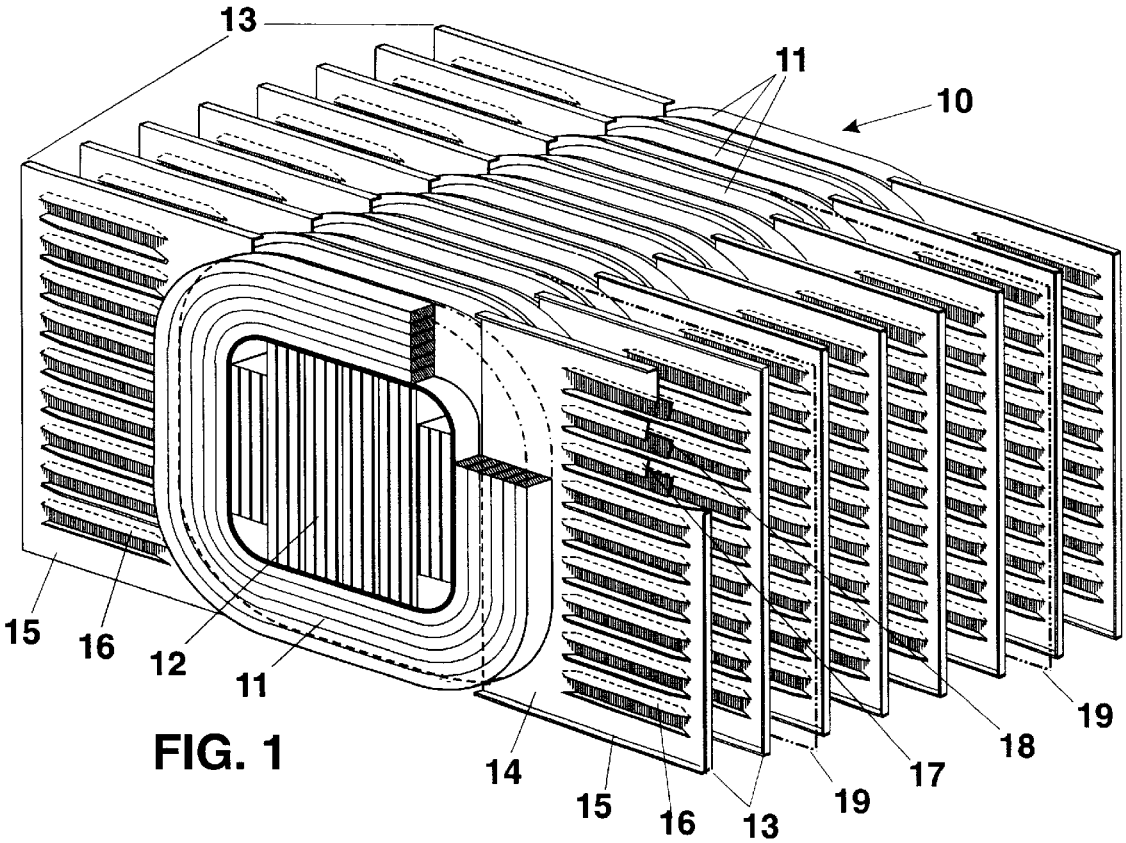
FIG. 1 is a perspective view partially broken away, illustrating a set of disc coils interleaved with vertical dissipators on a horizontal core leg.

FIG. 1 illustrates a partial sectional perspective view of a winding structure of a transformer which has improved heat dissipation characteristics by convection in relation to a cooling medium. FIG. 1 displays a core leg in cross section having horizontal axis of orientation. A winding structure 10 is assembled from sixteen coil discs 11 on core leg 12. The discs 11 are lined up along the axis of orientation of the core leg 12, stacked horizontally in axial relation along the leg, and have a plane vertical heat transfer surface and an outer marginal edge. Between each pair of the coil discs 11 a vertical heat dissipator 13 of generally plane construction is inserted. The first coil and the first dissipator is shown in partial sectional view to illustrate the inner structures. The heat dissipators are including a layer of continuous non-magnetizable highly heat conductive material having a substantially plane contact surface 14, defining a reference plane. Tight mechanical contact and improved heat conductive relationship is maintained between the contact surface and the transfer surface on the side of each disc to reduce the internal temperature gradient. A louver-like structure 15 is connected to each dissipator layer closely adjacent the outer marginal edge of the discs and extending beyond their edge, The louver-like structure 15 is subdivided into a multiplicity of fins 16. The fins are separated into distinct groups 17, 18 spaced apart from the reference plane 14 of the dissipator. Extended insulating barriers 19 can be placed between different windings. Due to the horizontal positioning of the core leg and the winding structure, each of the discs has equal rate of dissipation. Every disc has equal access to fresh cooling medium.

Figure 2:
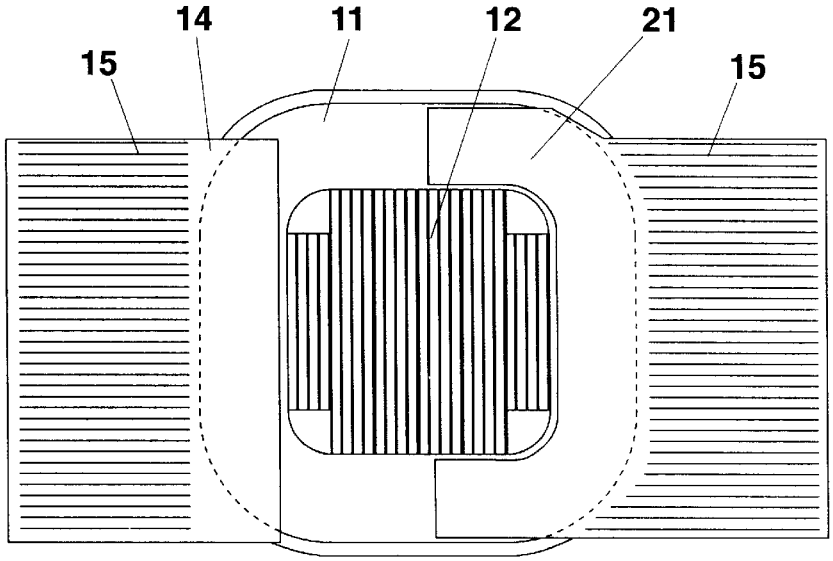
FIG. 2 is a side elevation view of a disc coil with two versions of heat dissipators and a sectional view of the core leg shown in FIG. 1.

FIG. 2 shows the transformer in FIG. 1 in side elevation with two versions of plane dissipators and a sectional view of the leg. Coil 11, core leg 12, and dissipator 14 and its louver-like structure 15 are identical to the same parts in FIG. 1; dissipator 21 is a version stamped from the metal sheet with an extended contact surface. This version is justifiable when the insulating layer between the contact surface and the transfer surface causes intolerable internal temperature gradient.

Figure 3:
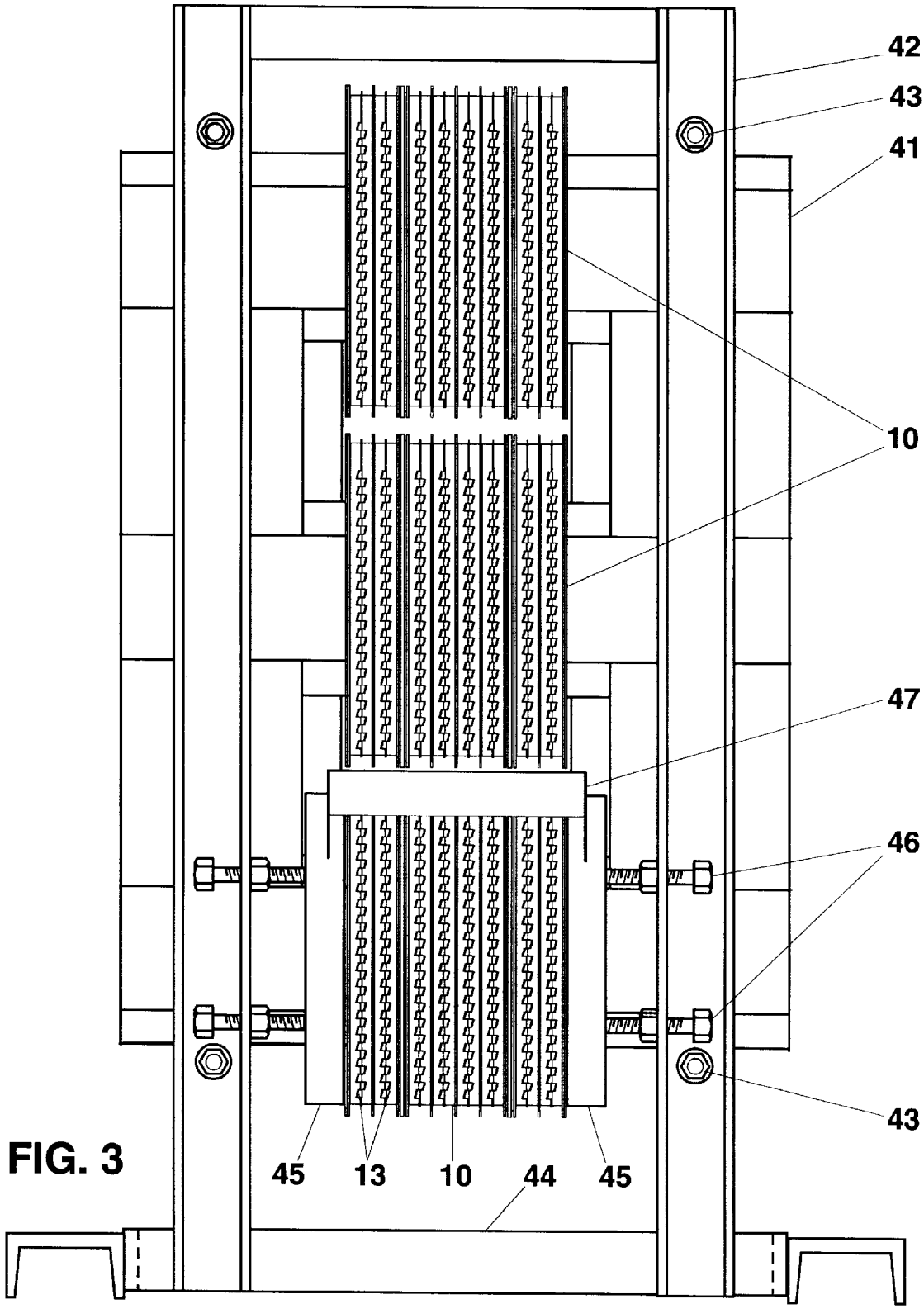
FIG. 3 is the front elevation view of a small footprint three phase transformer with windings shown in FIGS. 1 and 2 mounted on superimposed horizontal core legs, with upper baffles and pressure plates removed.
Figure 4:
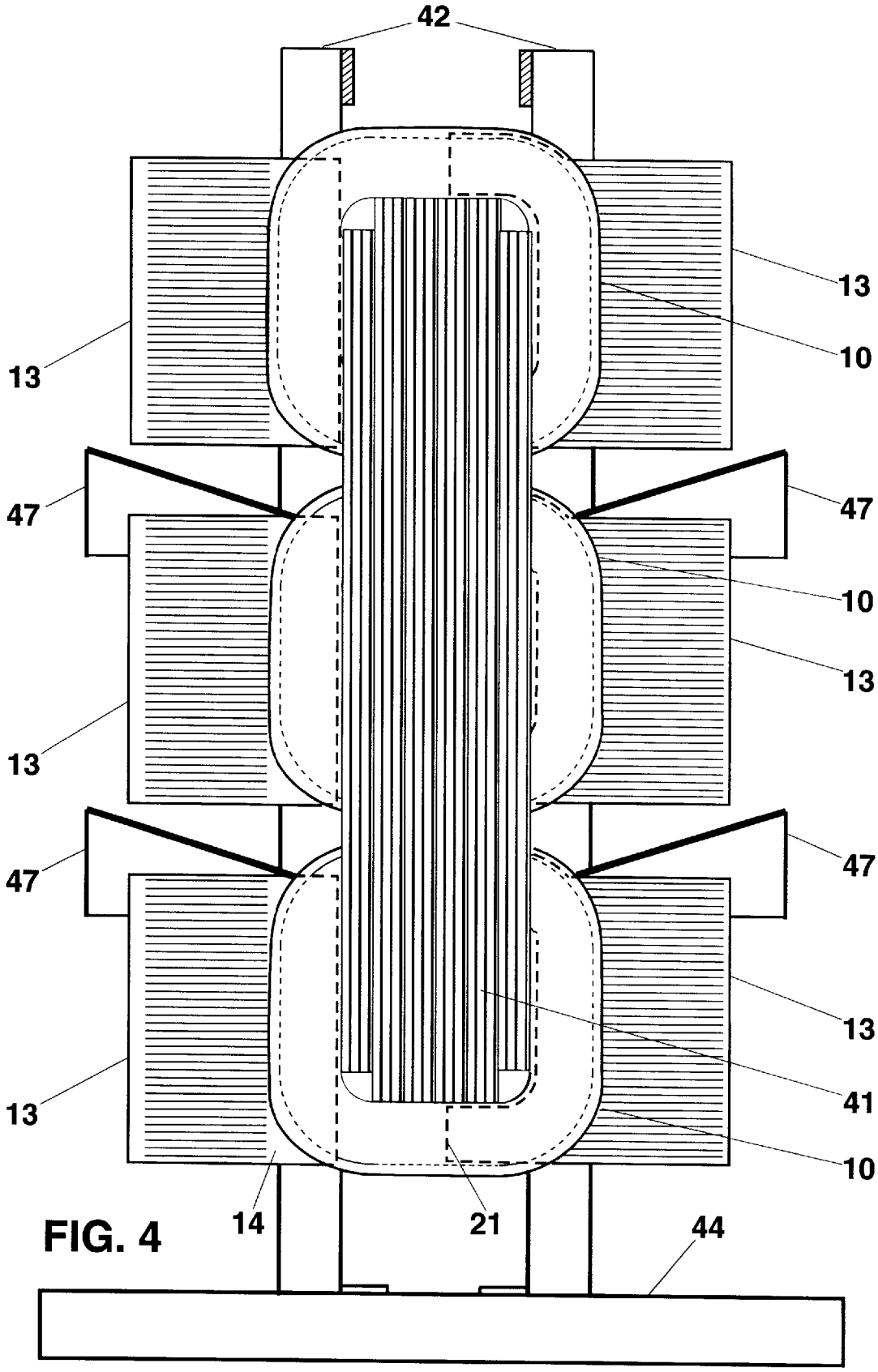
FIG. 4 is the side elevation view of the transformer shown in FIG. 3.

FIG. 3, is the front elevation, FIG. 4 is the side elevation of a small footprint three phase transformer built with three windings identical to the winding shown in FIG. 1. Three winding structures 10 are assembled on a conventional three phase core 41 with its yoke turned vertical while its legs have horizontal orientation. In this position, the three windings on the core legs are superimposed vertically. The core is supported by two solid rectangular frames 42 pressed against the core by bolts 43 and firmly anchored to the horizontal pedestal 44. Two pressure plates 45 are applied to the sides of all three winding structures on both sides of the core and tightened up against frames 42 by bolts 46 (shown only on the lowest winding in FIG. 3). Plane dissipators 13 are inserted in each coil pair of the winding structures 10 with simple rectangular contact surface 14 on the left side on FIG. 4, and with extended surface 21 on the right side. On this winding structure all discs and dissipators are horizontally disposed. Every disc has equal access to fresh cooling medium. Each disc has equal rate of dissipation.

To prevent the preheated cooling medium to enter the dissipators of the upper windings, baffles 47 are inserted between windings (only the lowest baffles are shown).

It is important to apply firm pressure by means of plates 45 and bolts 46 over the discs. This way tight mechanical contact and improved heat conductive relationship exists between transfer surfaces and contact surfaces. Reducing all gaps between the dissipators and discs, the internal temperature gradient is greatly reduced. Furthermore, heavy short circuits create significant forces between primary and secondary windings, and tend to push them apart; therefore the proper dimensioning of these parts is crucial.

Figure 5:
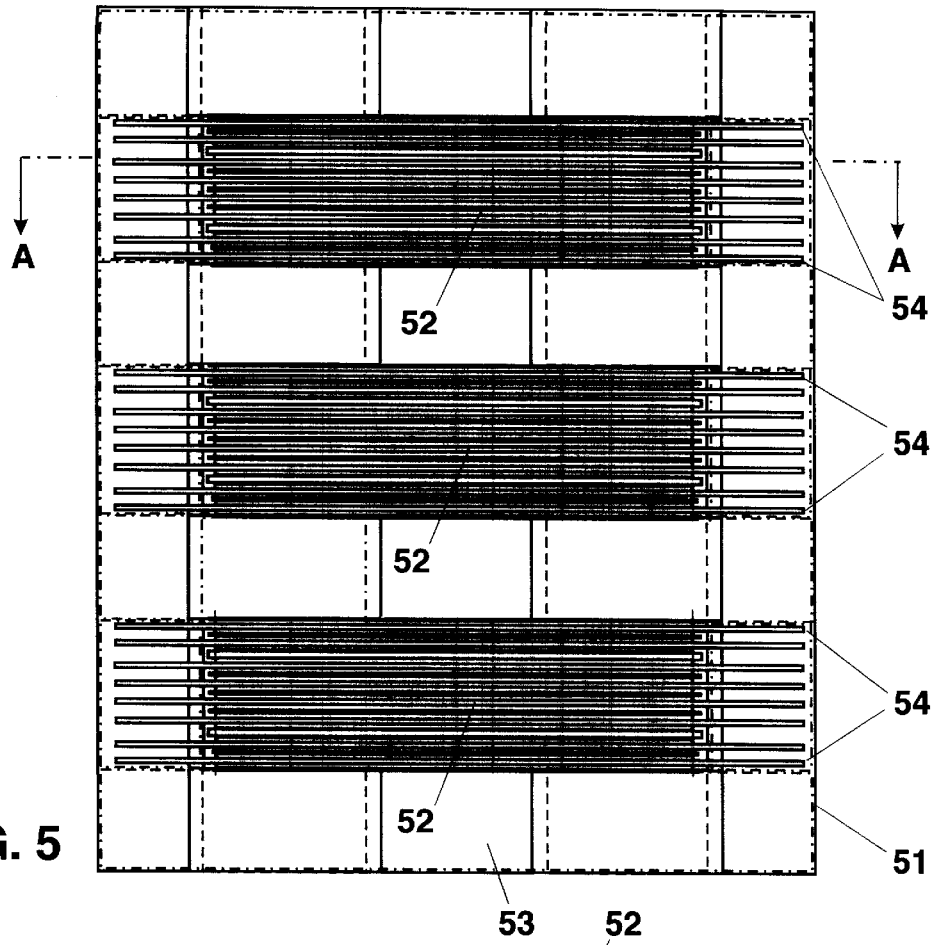
FIG. 5 is the front elevation view of a three phase transformer with superimposed vertical core legs and a shell type core.
Figure 6:
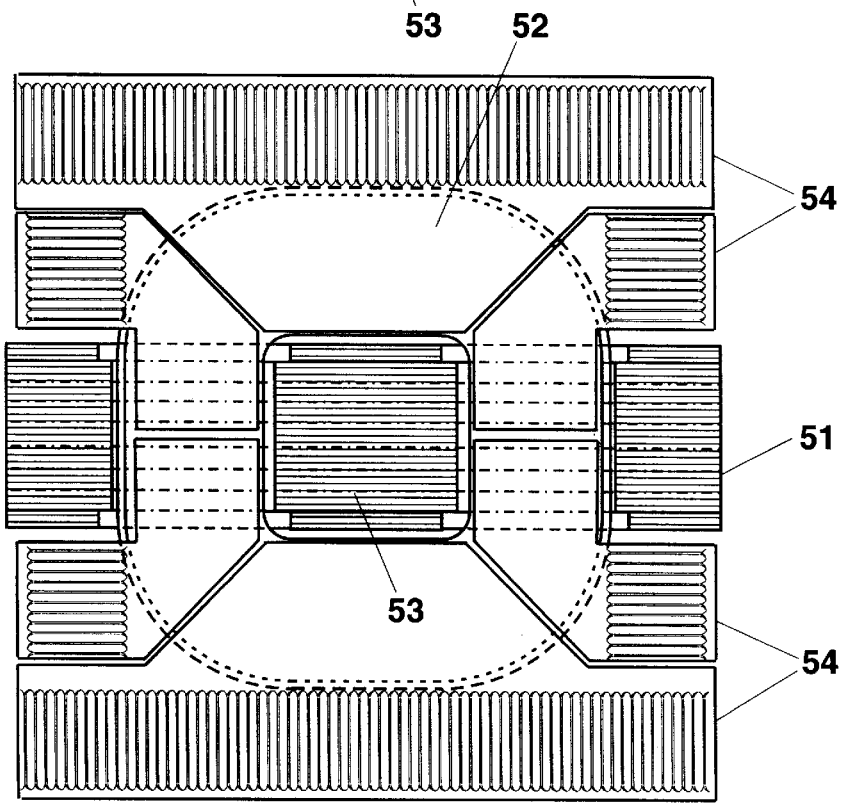
FIG. 6 is a sectional view taken along sectional plane A—A in FIG. 5, showing all dissipator sheets in plan view.

FIG. 5 is a front elevation of a transformer according to the present invention, FIG. 6 is a sectional plan view of the same, taken along sectional plane A—A in FIG. 5. On a three phase shell-type core 51 three winding structures 52 are superimposed vertically on vertical core leg 53. The core leg has generally vertical axis of orientation. In each winding structure 52 eight layers of plane dissipator groups 54 are inserted. Each disk have substantially horizontal transfer surfaces.

FIG. 6 shows one complete layer of a dissipator group 54 in plan view. The contact surfaces cover the entire horizontal transfer surface of the disc 52. The louver-like structure extends into a larger area filling up the available cross section around the unit. In this arrangement, the entire transfer surface area of the discs on each leg is accessible for direct engagement with the contact surface of the dissipators. Due to the maximum contact of the dissipators both internally to the discs and externally to the cooling medium, both internal and external temperature gradients are reduced. Part of this gain is used up for compensating for the temperature peak which develops in the upper coils of the winding structures. The cooling is somewhat reduced due to the preheated cooling medium the upper discs receive from the lower discs. A large volume of the cooling medium involved because of the large area covered by the louver-like structures. Thus the temperature peak is not significant. Baffles (like 47 in FIG. 4, not shown here) are positioned between the winding structures to provide fresh cooling medium to the upper windings. Four levels of core clamps (not shown) provide mechanical rigidity, and support for the pressure plates (not shown) on both sides of the windings.

ADVANTAGES OF THE PRESENT INVENTION

The winding structures of FIGS. 1 to 6 introduce significant improvements into the transformers. These improvements can be utilized for two purposes:

(1) energy saving;

(2) material saving.

The present invention can be compared to two versions of the prior art:

(A) Conventional technology presently in general use;

(B) Superior prior art, presently not used:

(1A) Energy saving version, compared to conventional technology:

Compared to the presently generally used conventional transformer technology, the following superior characteristics can be achieved by the use of the present invention without increasing the conventional material content and production costs:

(a) Up to 60% less winding losses.

(b) Lower operating temperature rise (about 60 C., 40% of the conventional 150 C.).

(c) Extended life expectancy (at least double of the conventional, due to the low temperature rise).

(d) Greatly increased overload tolerances:

(d1) continuously: up to 1.42 times of the nominal load.

(d2) intermittently: up to four times the conventional time.

(e) Unprecedented mechanical strength; indestructible by short-circuit forces (ductless construction; the core and coils are integrated into compact solid units.)

(f) Low noise level (short core legs generate less noise, integrated with coils which act like dampers).

(g) They can be built with a small footprint for reduced floor space.

(h) The metal sheets interleaved with coils increase the internal capacitance of the winding structure. Thus, voltage surges find a capacitive bypass, and do not break down the winding insulation.

(2A) Material saving version, compared to conventional technology:

The material saving version offers the following superior characteristics which is achieveble while reducing the active weights, winding losses, and production costs:

(a) Up to 20% reduction of core material;

(b) Up to 40% reduction of winding material;

(c) Up to 28% less winding losses.

(d) Increased overload tolerances:

(d1) continuously: up to 1.1 times of nominal load.

(d2) intermittently: up to four times the conventional time.

(e) Unprecedented mechanical strength; indestructible by short-circuit forces (ductless construction; the core and coils are integrated into compact solid units.)

(f) Low noise level (short core legs generate less noise, integrated with coils which act like dampers).

(g) They can be built with a small footprint for reduced floor space.

(h) The metal sheets interleaved with coils increase the internal capacitance of the winding structure. Thus, voltage surges find a capacitive bypass, and does not break down the winding insulation (B) Compared to the relevant, presently not used prior art:

(the only relevant prior art uses dissipator cooled layer-wound transformers)

The most significant improvements in the present invention are as follows:

(m) The winding structure composed of narrow coil discs stacked in axial relation along the core leg. Each disc has its own plane dissipator inserted at the end of the assembly operation. Each winding have equal access to fresh cooling medium regardless to the size of the transformer.

(n) The core legs with the windings superimposed vertically building up tall transformers. This type of arrangement increases the flow of cooling medium due to the increased chimney effect, reducing the peak temperature of the windings. This effect results in increased kVA rating.

(o) The winding structure generally has two groups of discs, and most of the discs in the same group are identical. Thus they can be wound at the same time in multiple winding arrangement between flanges on the mandrel. Discs for higher voltage can be wound random, with twisted parallel wires to reduce eddy-current losses. It is practical to impregnate the windings before removing them from the fixture, and converting them into solid discs for facilitating the assembly operation.

(p) All dissipators are identical prefabricated simple plane sheets extended with louver-like structures, inserted into the discs at the end of the assembly of the transformer without any modification.

(q) The heat moves along the short axial dimension of the discs to the dissipator, and flows along the short radial portion of the dissipator. Consequently, the internal temperature gradient is minimized.

(r) All windings have equal access to fresh cooling medium and have improved cooling due to the increased chimney effect. The improved cooling and the reduced internal temperature gradient results in lower peak temperature in the winding. Consequently, the kVA rating of the transformer is proportionally larger, being in inverse relationship with the peak temperature.

ADDITIONAL EMBODIMENTS

Figure 7:
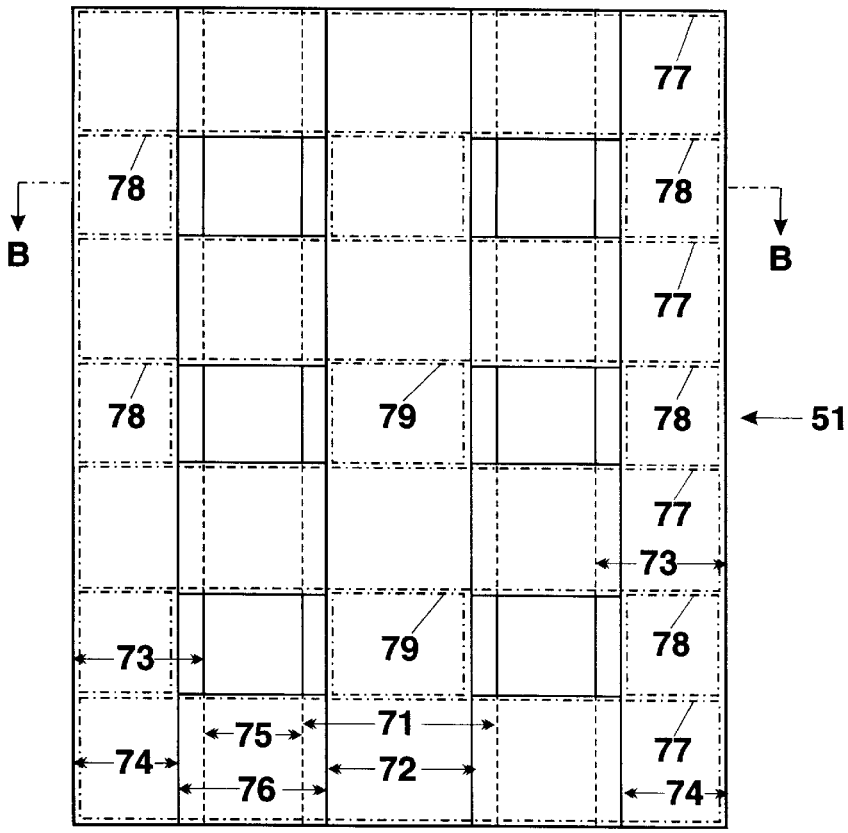
FIG. 7 is the side elevation view of the core of the transformer shown in FIGS. 5 and 6.
Figure 8:
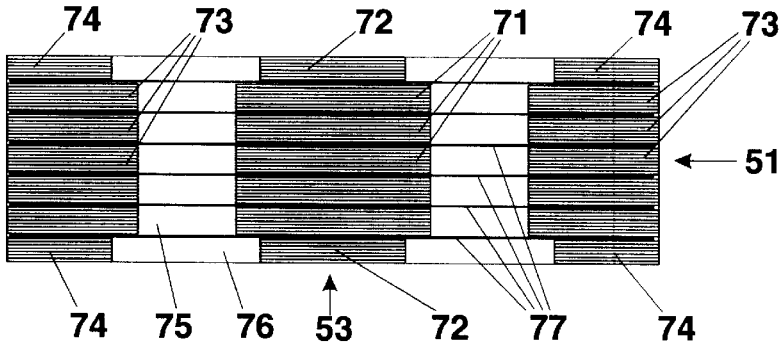
FIG. 8 is a sectional view of the core taken along plane B—B in FIG. 7.

FIGS. 7 and 8 illustrate the shell type core structure used in FIGS. 5 and 6. The core 51 is constructed from building blocks e.g. 71, 72, 73, of steel lamination stacked to have equal height and assembled with butt joints. The wider leg blocks 71 and the end blocks 72, and the yoke blocks 73, 74 extend to the entire length of the leg. Two short filler blocks 75, 76 close the magnetic circuit. After each block is in place on the same level, tie sheets 77 placed over the assembled blocks to bridge all butt joints, and to serve as mechanical connection between the blocks. Filler sheets 78, 79 are placed between tie sheets on the same level to complete the magnetic circuit between them. At least the shorter blocks 73, 74 can be provided with adhesive means for converting them into solid objects to facilitate the assembly of the core.

Figure 9:
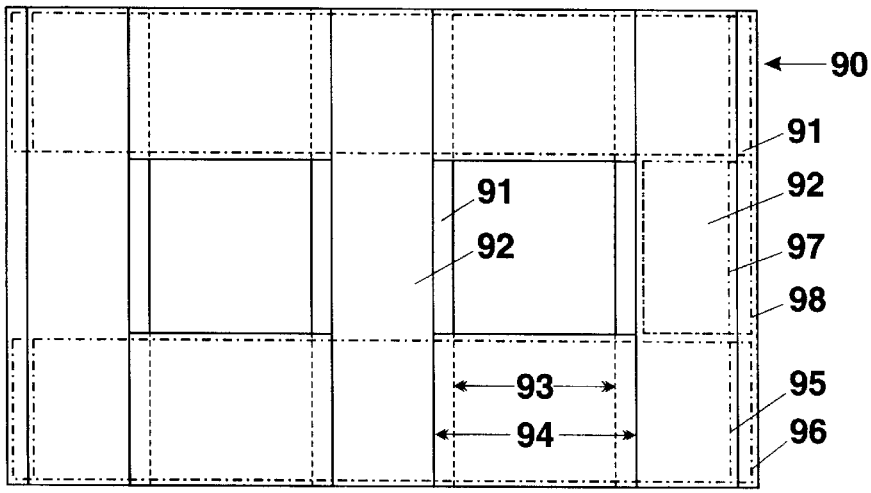
FIG. 9 is the side elevation view of the core of the transformer shown in FIGS. 3 and 4.

FIG. 9 illustrates a conventional three phase core 90 built in the same style as the core 51 in FIGS. 7, 8 and used in the transformer shown in FIGS. 3, and 4. The wider leg blocks 91 and the end blocks 92 extend to the entire height of the core. Two short filler blocks 93, 94 close the magnetic circuit. A pair of tie sheets 95 for the shorter end blocks 92, and 96 for the wider leg bocks 91 are placed over the blocks on each level bridging the structure horizontally, and serve as mechanical connection. Filler sheets 97, 98 are placed between tie sheets on the same level to complete the magnetic circuit between them.

It is advantageous to use close to square windows in both core types. In cores with short windows, the portion of the core having high flux density is minimum. By keeping the proportion between the longer and the shorter side of the window between 1:1 and 1:1.5, a core structure built with block assembly has lower losses and weight, low exciting current and noise level, and requires significantly reduced labor time. Approaching the optimum format, the toroid, secures these effects.

The assembly of these cores can be facilitated by converting at least the short blocks into solid objects by using adhesive materials, e. g. vacuum impregnation. The best procedure is to provide tools with a number of cavities for the short blocks. After filling up the cavities tightly with precut steel, vacuum impregnation can be done on the whole group in the tool. After curing, and removing them from the tool, the contact surfaces require cleaning and a slight grinding. This grinding should be done for the whole group together on a surface grinder to avoid any deviation of the dimension. After this preparation, the core can be assembled in horizontal position easily and quickly even without converting the long steel stacks into solid objects.

The last operation is the closing of the gaps in the butt joints. First all terminals covered for safety, and core bolts slightly loosened. Next, the normal voltage is applied to one of the windings in standard no-load test connection to excite the normal magnetic flux in the core. By hammering the core with a pneumatic or magnetic hammer and watching the core loss and exciting-current values, the minimum can be quickly achieved. After re-tightening the core bolts without switching of the flux, the transformer is ready to be released for final processing and testing.

Figure 10:
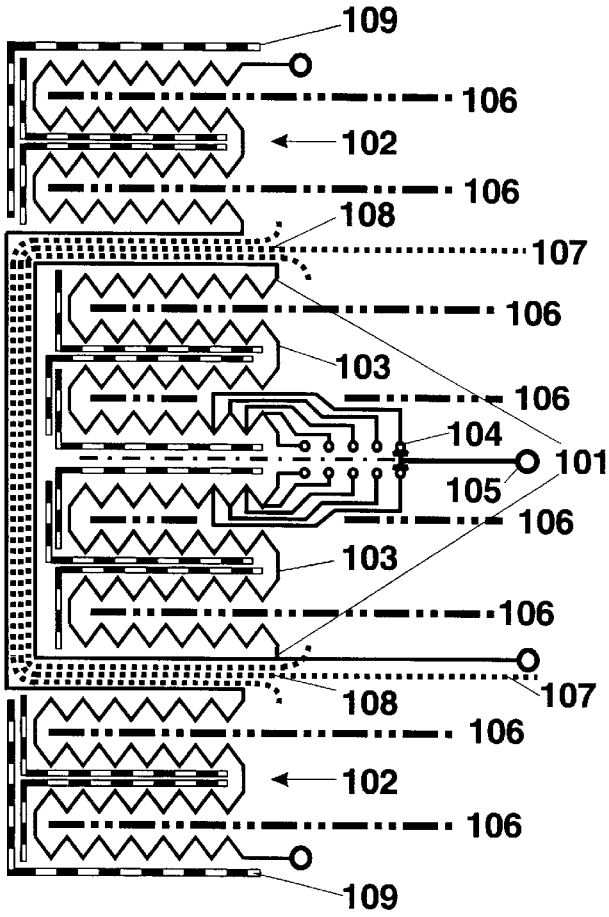
FIG. 10 is a schematic diagram illustrating the connection of the coils of a transformer with a high voltage primary winding built with two parallel branches and a tap changer at the center terminal, with the location of the dissipators and the insulation marked up.

FIG. 10 is a schematic diagram illustrating the connection of the coils of a transformer having two separate winding: a high voltage winding, and a low voltage winding. The discs of the high voltage winding structure 101 positioned on the center of the core leg between two groups of low voltage discs 102. The high voltage winding connected in two parallel branches 103 and has a tap changer 104 at the center starting terminal 105. The two branches are progressing from the center toward the two groups 102 of low voltage discs. Groups 102 are connected in series. Each dissipator can be connected to the common (inside) connection of the contacted two discs, or left floating. The location of the dissipators 106 and the extended insulation barriers 107 of laminated main insulation 108 are marked up. The discs are insulated by prefabricated L-rings 109.

Figure 11:
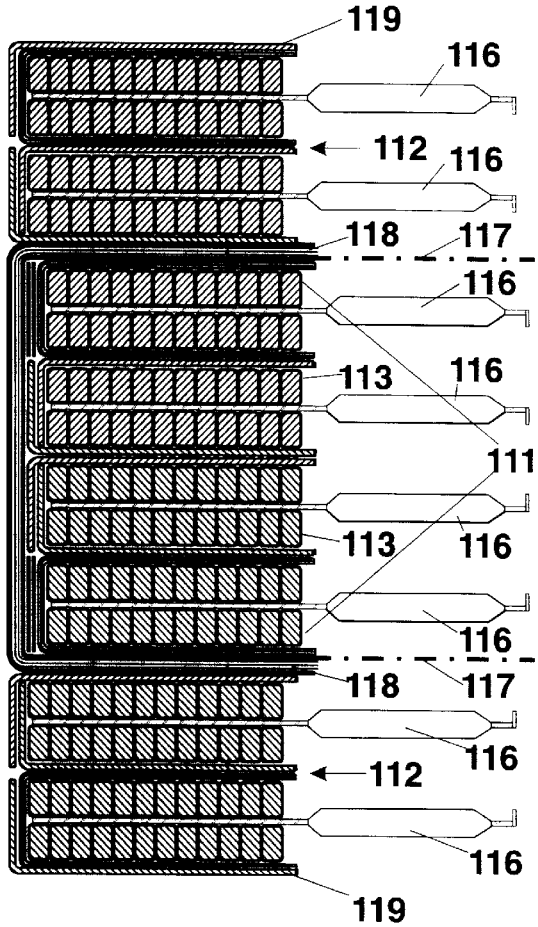
FIG. 11 is a sectional view of the winding of a transformer of FIG. 10, except with low voltage windings.

FIG. 11 is a sectional view of the windings of the transformer described in FIG. 10, except with two low voltage winding systems. Primary winding 111 positioned on the center of the core leg between two groups of secondary discs 112. The primary winding connected in two parallel branches 113. Tap changer and terminals are not shown. The two groups of secondary discs 112 are connected in series. The dissipators 116 are shown, and the extended insulation barriers 117 of laminated main insulation 118 are marked up. The discs are insulated by prefabricated L-rings 119.

Figure 12:
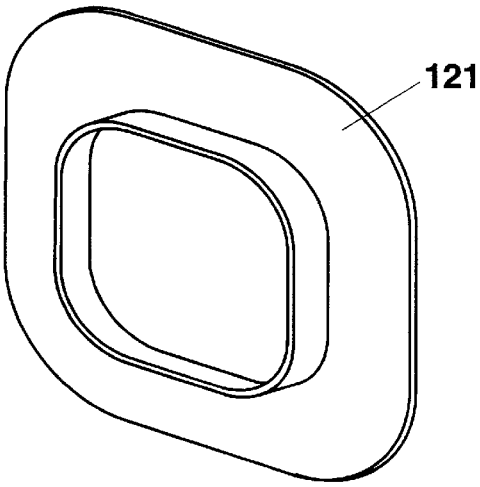
FIG. 12 is a perspective view of a prefabricated L-ring.

FIG. 12 is a perspective view of a prefabricated L-ring 121. Two such rings, one with slightly enlarged core tube diameter can be matched and used to cover a disc pair as shown in FIGS. 10 and 11 as 109 and 119. It can be produced from any suitable insulating material also in circular form when needed.

Figure 13:
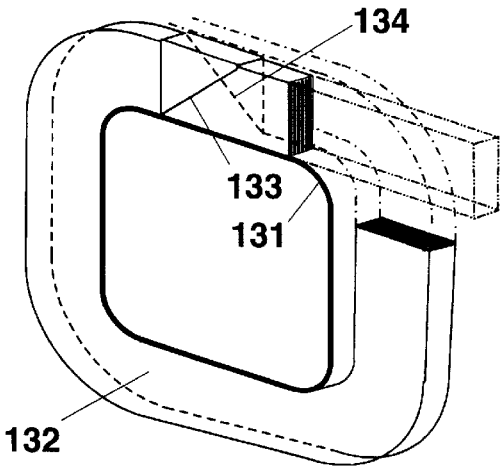
FIG. 13 is a perspective view of a cyclical crossover of a helical coil built up from parallel stamped layers.

FIG. 13 is a perspective view of a cyclical cross-over of a helical coil built up from a number of parallel stamped sheet metal conductors equalized by cyclical crossovers. To avoid uneven current distribution and additional losses, the position of each individual conductor is cyclically changed to provide equal presence for each conductor in every position. This balancing act can be performed most conveniently in the window side of the disc where no dissipator occupies space. On a core tube section 131 one turn 132 of a helical coil is shown. On the top side of the turn the closest conductor is folded up along a 45 degree line 133. After folding it down and along line 134, it joins the parallel group on the far side. After repeating this operation for every conductor in the subsequent turns, the current distribution will be even. Each parallel conductor carries substantially equal current.

Figure 14:
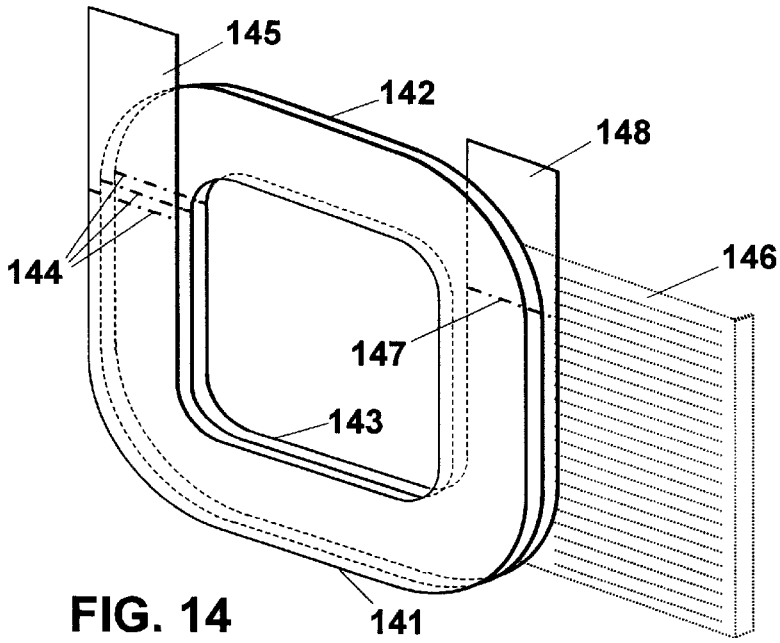
FIG. 14 is a perspective view of a helical coil assembled from welded sections where one section has an extension prefabricated as a louver-like structure.

FIG. 14 is a perspective view of a helical coil assembled from plane sheet metal turns welded together. One turn has an extension prefabricated as a louver-like structure including fins spaced apart from the plane of the turn. It is closely adjacent the outer marginal edge of the discs and extending beyond their edge. It creates an integrated dissipator and winding. On FIG. 14, three ring-like sheet metal turns 141, 142, and 143 are shown. Each turn is produced by stamping and cuffing open the ring at a radial line 144. The beginning of the first turn 141 is welded to lead 145, and its end is welded to the beginning of the next turn 142 building up a helical coil. The second turn is extended to include the louver-like structure 146. The last quarter portion of the third turn 143 is cut off at line 147 and welded to lead 148. The combination of winding material and dissipator saves material and reduces the internal temperature gradient, but requires additional tooling.

DISSIPATOR EMBODIMENTS

FIGS. 15 to 21 pertains to sheet metal heat dissipators including their configuration, applicability, and production.

Figure 18A:
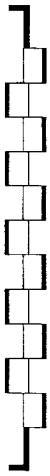
FIG. 18 illustrates six versions of vertical dissipators.
Figure 18B:
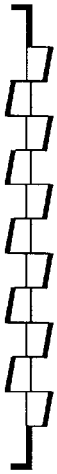
Figure 18C:
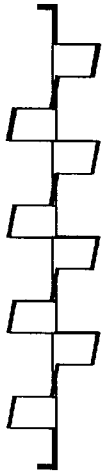
Figure 18D:
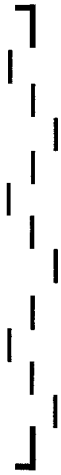
Figure 18E:
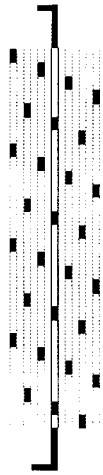
Figure 18F:
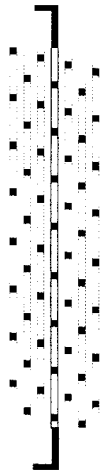

FIG. 15 is production tooling for dissipator version FIG. 18F. It will be described later in connection with FIG. 18F.

Dissipators can be categorized in two main groups: (a) using horizontal louver-like structures; (b) using vertical louver-like structures. One of their common feature is the orientation of the major surface of their fins: the deviation from vertical is less than 45 degree in both versions.

The horizontal type can also be combined with vertical a contact surface. It requires a 90 degree bend. The vertical type works only with a vertical contact surface.

Figure 16:
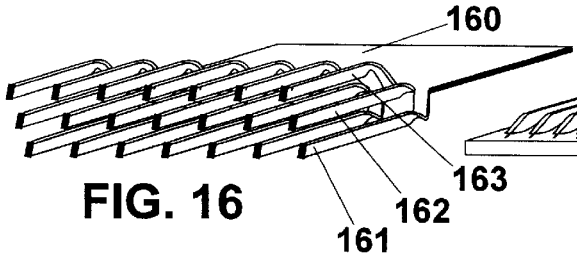
FIG. 16 is a horizontal dissipator with fins spaced apart into three levels.
Figure 17:
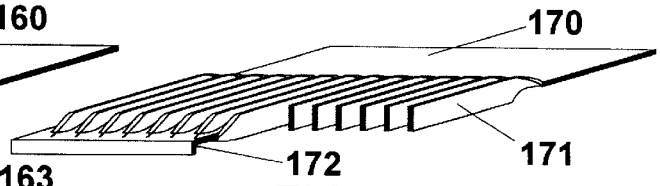
FIG. 17 is a horizontal dissipator with fins spaced apart by turning vertical.

FIGS. 16 and 17 are horizontal dissipators. FIG. 16 illustrates a horizontal dissipator in partial sectional perspective view showing the louver-like structure in cross-section generated by a vertical plane. (The end strip connecting the outer ends of the fins is removed.) In this fin arrangement FIG. 18C version of fins are used with modification: the major fin surfaces turned close to vertical. The reference plane is contact surface 160. To provide sufficient channels for the flow, its fins are spaced apart from the reference plane arranging the fins in three groups 161, 162, 163. Fins in group 161 moved down, in group 163 moved up, in group 162 left at the reference plane.

FIG. 17 illustrates the simplest horizontal dissipator. It has a plane contact surface 170 as a reference plane. Fins 171 are spaced apart by turning their major surface close to vertical. A common strip is connecting the end of the fins with a fold 172 to provide mechanical rigidity to the fin structure. These fins can be stamped and turned into close to vertical position in a single stamping operation. If the major surface of the fins tilted less than 45 degree away from vertical, this dissipator can also be used with louver structure not in horizontal position, but with the long dimension of the fins kept close to horizontal. A practical proportion for the width of the fins is about ten to fourteen times the thickness of the metal sheet. Using narrower fins, the channel width of the flow narrows more. Using fins having width twice the thickness of the sheet, the channel width is reduced to one thickness. Caution: narrow channels tend to clog up.

FIG. 18 illustrates six versions of different fin arrangements in sectional view cut by a plane perpendicular to their reference plane. Versions A to E are shown with fin orientation for vertical application. Version F can be used in both horizontal and vertical orientation without any change.

The version in FIG. 18A shows the simplest vertical fin arrangement: the fins are arranged in two groups: displaced from the base plane both to the left and right direction with no tilting.

The version in FIG. 18B is similar to 18A, but its fins are slightly tilted. This fin arrangement is used in FIG. 19 which is a partial sectional perspective view of a vertical dissipator.

The version in FIG. 18C has fins arranged in three groups, fins slightly tilted, and with cycles repeated in "writing" sequence. This arrangement is used in FIG. 16 with fins turned vertical, perpendicular to the reference plane.

The version in FIG. 18D has fins arranged in three groups with cycles repeated in zig-zag sequence with no tilt.

The version in FIG. 18E has fins arranged in seven levels with cycles repeated in "writing" sequence with no tilt. The fins are narrow having 2:1 cross-sectional proportion, and are shown against a background of parallel lines used at the design of the fin arrangement. This type of fins are used to design the dissipator shown in FIG. 20 in partial sectional perspective view.

The version in FIG. 18F has fin arrangement similar to 18E, but with 1:1 cross-sectional dimensions. This version does not have a major fin surface: it has fins with square cross-section. Therefore, dissipators equipped with this fin structure can be used in any position as long as the fins are kept close to horizontal.

Figure 19:
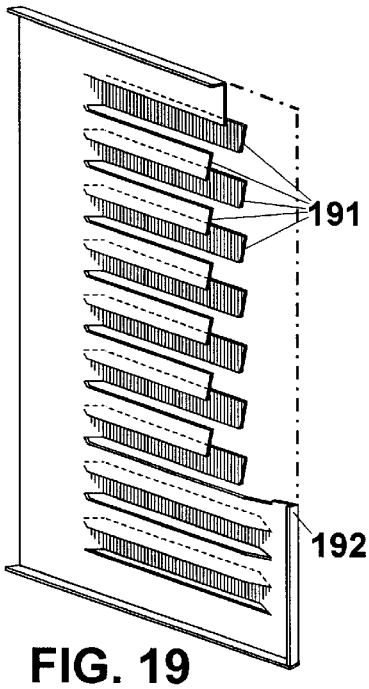
FIG. 19 is a perspective view partially broken away, illustrating a dissipator according to the profile in FIG. 18B.

FIG. 19 is a partial sectional perspective view of a vertical dissipator. It is equipped with fin structure 191 according to FIG. 18B. Fold 192 on its end strip provides mechanical rigidity to the fin structure.

Figure 20:
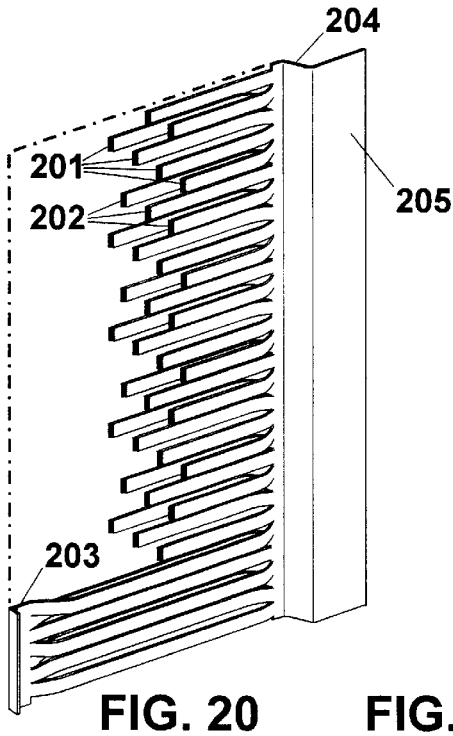
FIG. 20 is a perspective view partially broken away, illustrating a dissipator according to the profile in FIG. 18E.

FIG. 20 is a partial sectional perspective view of a vertical dissipator. It is equipped with fin structure according to FIG. 18E. At this fin arrangement, seven fins constitute a cycle in two sets: four fins 201, and three fins 202. This arrangement offers the widest channels to the flow. Fold 203 provides mechanical rigidity to the fin structure. Step 204 shifts the louver-like structure out of the plane of the contact surface 205 for double (or triple) applications.

Figure 21:
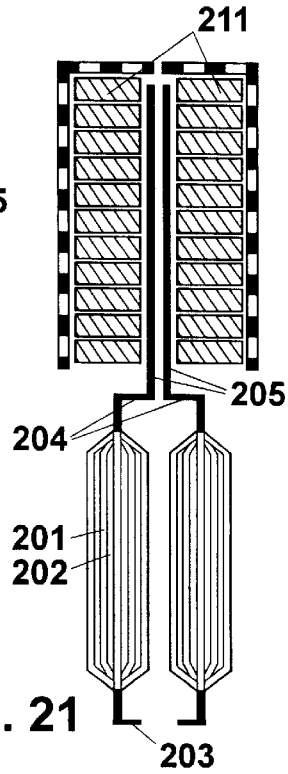
FIG. 21 is a sectional view of a double disc with two dissipators according to FIG. 20 inserted.

FIG. 21 is a plan view of the cross-section of a pair of discs 211 enclosing two dissipators according to FIG. 20. Their contact surfaces 205 are inserted between two discs 211. Steps 204 shift fins 201, 202 out of the plane of the two dissipators. Thus they can be accommodated without interference between the same transfer surfaces of the winding structure. A third dissipator without a step 204 can also be inserted between the first two dissipators.

DESIGN ASPECTS OF DISSIPATORS

Narrower fins have rapidly improving heat dissipation characteristics. The simultaneously narrowing channels, however, slow down the flow, and cancel out a large part of the improvement. To save this improvement, the channels can be enlarged by spacing apart the fins from their reference plane in both direction.

Louver-like structures can be produced with large numbers of variations for both horizontal and vertical applications. Two aspects control their design: (1) fins having narrower dimension along the flow have better heat dissipation; (2) spacing the fins apart, inserting larger gaps between them, improves the dissipation by increasing the flow of the cooling medium.

The production of louver-like structures with one or two fin groups can be done in a single operation with one tool. Examples: FIG. 18A two groups displaced into two positions; fins in FIG. 18B and in FIG. 19 (191) are the same, but with a slight tilt; fins 171 are only twisted with no displacement. These structures, however, cannot be successfully used with very narrow fins. The gaps within the same group become too narrow, reducing some of the gain in the heat transfer.

To achieve better heat transfer by narrowing the fins, and maintaining ample flow, more elaborate displacement patterns are needed. Using fins arranged sequentially in two sets alternating along the louver-like structure is a favorable solution.

The number of fins contained by the first set is larger by one than the number of fins contained by the second set. Thus one set has odd number of fins, the other has even number of fins. The fins in both sets are displaced in sequence, symmetrically within the same set on both side of the reference plane. The displacement in each set starts on the same side, introducing substantially equal distance in both sets between two subsequent fins within the same set. The displacement of the fins continues in the two sets repeatedly in accordance with the sequence of the fins. A concrete example for this two-set arrangement is presented below in connection with FIG. 20.

The least complex "two set" arrangement is shown in FIG. 18C: in the "odd" set, there is only one fin; it remains in the reference plane. The "even" set contains two fins moved to opposite sides of the reference plane. By increasing the number of fins in each set by one, the "odd" set has three, the "even" set has two fins. By increasing the number of fins by two, the "odd" set has three, the even set has four fins. This arrangement is shown in FIGS. 18E and 18F, and in FIG. 20. Here, "18E" type louver-like structure is used. The even set has four fins 201, the odd set has three fins 202, alternating along the structure in cycles containing 7 fins.

The drawing in FIG. 18E, shown against a background of parallel lines used at the design of this fin arrangement, illustrates the positions of the fins. The distance between the parallel lines is equal to the thickness of the dissipator sheet, "ds" for short reference.

FIG. 20 is partial sectional perspective view of a dissipator designed using the arrangement of FIG. 18E. The fin cycle comprising seven fins arranged in two sets. The first set contains the first four fins 201 in sequence. The displacement in the present case between subsequent fins in the same set is 4 ds. The first fin in the first set is displaced by 6 ds to the left from the reference plane. The second fin in the sequence is displaced by 2 ds to the left. The third fin is displaced by 2 ds to the right. The fourth fin is displaced by 6 ds to the right. The second set contains the last three fins 202. The first fin in the second set (fifth in the sequence) is displaced 4 ds to the left. The second fin in the second set remains in the reference plane. The third fin is displaced by 4 ds to the right. This seven fin cycle is repeated in the same sequence. The major surface of the fins are vertical. The fins are narrow: having 2:1 cross-sectional proportion. The spacing is ample: 3 ds horizontally, and six fin width vertically, equal to 12 ds.

The version in FIG. 18F has fin arrangement identical to version 18E, except the fins have square cross-sections. Thus, this version does not have a major fin surface. Therefore, dissipators equipped with this fin structure work equally well in any position as long as the fins kept close to horizontal. This arrangement offers the best heat transfer achievable with sheet metal splitting.

In this fin structures, the feasible amount of displacement can be determined on the basis of the elongation capacity of the sheet metal used. The fins further out from the reference plane are stretched, while the closer ones compressed by the forming tool. Soft electric conductor-quality pure metal can handle considerable deformation without tearing. Another factor to be considered is the space available for the expanded fin structure. The wider the better: the resistance to the flow is decreasing with wider channels.

Figure 15A:
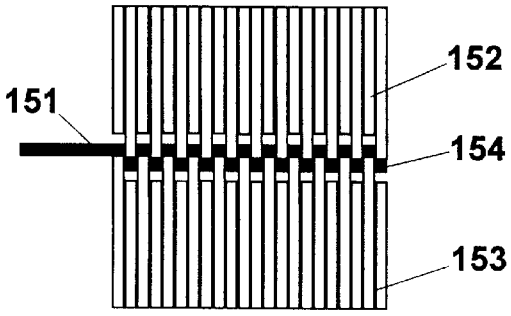
FIG. 15 illustrates four phases of the fabrication process of the dissipator shown in FIG. 18F.
Figure 15B:
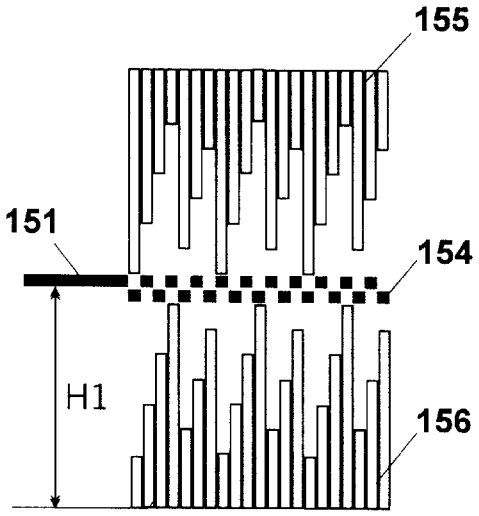
Figure 15C:
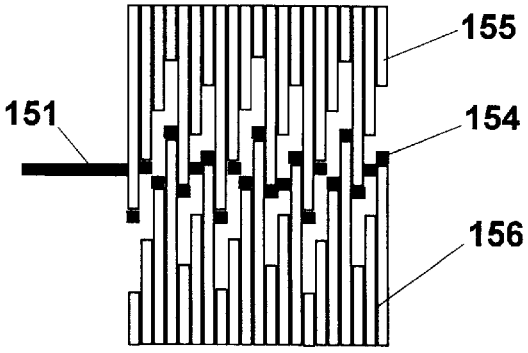

The production of fin structures having more than two groups to be displaced into more than two positions, is a two step operation. FIG. 15 illustrates the two tools, a multiple shear and a forming tool, and the steps of the production of one of these fin structures according to FIG. 18F. The multiple shear in FIG. 15A is shown in closed position; its role is to split the sheet metal into fins. FIGS. 15B, C, and D show the forming tool in three phases of the forming operation. Both tools have a fixed bottom section and a moving top section; both sections being built from the same blade elements. The process is as follows: with shear in FIG. 15A open, the strip of sheet metal 151 is introduced between moving section 152 and stationary section 153. By closing the shear, the sheet is sheared into 21 fins 154.

Figure 15D:
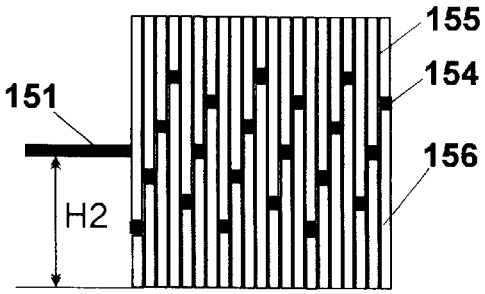

In FIG. 15B, the fins 154 are introduced between and aligned to the open moving section 155 and stationary section 156 of the forming tool. The metal strip is in H1 height. Closing the forming tool half way, shown in FIG. 15C, the blades of the forming tool moved the fins half way toward their final displacement. FIG. 15D illustrates the final position of the forming tool and the fins. The height of the metal strip has changed into H2.

These tools have a degree of adaptability: thinner or thicker metal can be used. The degree of displacement is also adjustable by shifting the vertical positions of the opposing blade pairs in the forming tool.

CONCLUSION, RAMIFICATIONS, AND SCOPE

The described small footprint transformers can be used with or without heat dissipators. The dissipator equipped version offers, in addition to smaller floor space requirement, low cost, high performance cooling for maintaining low operating temperatures with unsurpassed reliability, saving energy by lowering the losses, or saving active material. The past trend of allowing the operating temperature to rise to the limit of the endurance of the most heat resistant insulating materials resulted in high energy losses, reduced reliability, and shorter life expectancy. The application of the described affordable heat dissipators reverses this trend and assures significant energy savings, and extended life expectancy with the highest reliability.

The foregoing specification has set forth specific structures in detail for the purpose of illustrating the invention. It will be understood that such details of structure may be varied widely without departure from the scope and spirit of the invention as defined in the specification and in the following claims.

What is claimed is:

1. A power transformer exposed to a flow of gaseous oi liquid cooling medium, having heat dissipation by convection and comprising at least one winding structure on a first core leg and at least one other winding structure on at least one other core leg, each said winding structure having at least one heat transfer surface and warming up through energy losses generated by currents flowing through said winding structure, the improvement comprising:

(a) winding structures on said first core leg being superimposed over winding structures on at least one other core leg in vertical relation for creating a small footprint transformer, (b) at least one baffle positioned between said superimposed winding structures, diverting the preheated part of the flow of said cooling medium away from upper winding structures, said part being preheated by lower winding structures, and guiding flesh cooling medium toward said heat transfer surface of at least one of said upper winding structures (c) whereby said winding structures receive fresh cooling medium, resulting in even temperature rise in said winding structures, and said transformer can be installed on a smaller floor space having small footprint.

2. A transformer according to claim 1 further including (a) heat dissipator means comprising at least one layer of non-magnetizable highly heat conductive material having at least one contact surface and an extended portion subdivided into fin means for engaging said cooling medium flowing therepast, (b) means for establishing tight mechanical contact and improved heat conductive relationship between at least one of said transfer surfaces and at least one of said contact surfaces for receiving heat from at least one of said winding structures and transferring heat to said cooling medium through said dissipator means (c) whereby small footprint transformers can be built with significantly improved cooling and reduced temperature rise.

3. A transformer according to claim 2 further including (a) at least one core leg having an axis of orientation, and at least one winding structure comprising coil discs each having an outer marginal edge, and at least one heat transfer surface, said coil discs being adjacent and stacked in axial relation along said core leg, the improvement comprising:

(b) said heat dissipator means of the type inserted between said coil discs, having at least one substantially plane contact surface defining a first plane, (c) means for establishing tight mechanical contact and improved heat conductive relationship between the contact surface of said discs and said transfer surface for receiving heat from said coil discs, (d) said layer including at least one extended portion closely adjacent and extending beyond said outer marginal edge, (e) said extended portion comprising a louver-like structure for transferring heat between said contact surface and said cooling medium, (f) said louver-like structure comprising a multiplicity of substantially parallel fin means defining a central axis for each fin means extending through the center of each, (g) said fin means being created by the subdivision of at least one portion of said extension means along substantially parallel lines, said fin means having two substantially parallel main surfaces on opposed sides, two edge surfaces at a leading and a trailing edge with reference to the flow of said cooling medium, (h) said fin means being separated into at least two distinct groups, and at least one of said groups being spaced apart from said first plane by introducing a distance not less than the thickness of said dissipator layer between each of the central axis of said fin means in the spaced apart group and said first plane, (i) each fin means in at least one of said groups being rotated on their central axis into an angular deviation of less than 90 degrees with reference to said first plane (a) whereby increasing the gaps in said louver-like structure between main surfaces of adjacent fin means for allowing better access to said cooling medium flowing through said gaps exposing said fins means to faster flow on both of their main surfaces and at least one edge surface for increasing the engagement of said fin means with said cooling medium, achieving superior heat transfer between said fin means and said cooling medium.

4. A power transformer exposed to a flow of gaseous or liquid cooling medium having improved heat dissipation characteristics by convection and comprising at least a first core leg having substantially horizontal axis of orientation, and at least one winding structure assembled from coil discs each having an outer marginal edge, and at least one substantially plane vertical heat transfer surface, said coil discs being adjacent and stacked in axial relation along said first core leg, said winding structure warming up through energy losses generated by currents flowing through said winding structure, the improvement comprising:

(a) at least one of said heat dissipator means being inserted between said coil discs, having at least one substantially plane contact surface defining a first plane, (b) means for establishing tight mechanical contact and improved heat conductive relationship between at least one of said transfer surfaces and at least one of said contact surfaces for receiving heat from at least one of said coil discs, and transferring heat to said cooling medium through said dissipator means, (c) said layer including at least one extended portion closely adjacent and extending beyond said outer marginal edge, (d) said extended portion comprising a louver-like structure for transferring heat between said contact surface and said cooling medium, (e) said louver-like structure comprising a multiplicity of substantially parallel fin means defining a central axis for each fin means extending through the center of each, (f) said fin means being created by subdividing at least one portion of said extension means along substantially parallel lines, said fin means having two substantially parallel main surfaces on opposed sides, two edge surfaces at a leading and a trailing edge with reference to the flow of said cooling medium, (g) said fin means being separated into at least two distinct groups, and at least one of said groups being spaced apart from said first plane by introducing a distance not less than the thickness of said dissipator layer between each of the central axis of said fin means in the spaced apart group and said first plane, (h) each fin means in at least one of said groups being rotated on said central axis into an angular deviation of less than 90 degrees with reference to said first plane (i) whereby equal rate of dissipation can be established for each of said discs by providing equal access to fresh cooling medium, and by increasing the gaps in said louver-like structure between main surfaces of adjacent fin means to allow better access to said cooling medium flowing through said gaps exposing said fins means to faster flow on both of their main surfaces and at least one edge surface for increasing the engagement of said fin means with said cooling medium, achieving superior heat transfer between said fin means and said cooling medium.

5. A transformer according to claim 4 wherein (a) winding structures on said first core leg being superimposed over winding structures on at least one other core leg in vertical relation for creating a small footprint transformer, (b) at least one baffle positioned between said superimposed winding structures, diverting the preheated part of the flow of said cooling medium away from upper winding structures, said part being preheated by lower winding structures, and guiding fresh cooling medium toward said fin means of at lest one of said upper winding structures (c) whereby the floor space requirement of said small footprint transformer is reduced while equal rate of dissipation established for each of said discs.

6. A transformer according to claim 2 wherein (a) at least two core legs having generally vertical axis of orientation and each core leg accommodating at least one winding structure.

7. A transformer according to claim 6 further including (a) heat dissipator means comprising at least one layer of non-magnetizable highly heat conductive material having at least one contact surface and an extended portion subdivided into fin means for engaging said cooling medium flowing therepast, (b) means for establishing tight mechanical contact and improved heat conductive relationship between at least one of said transfer surfaces and at least one of said contact surfaces for receiving heat from at least one of said winding structures and transferring heat to said cooling medium through said dissipator means (c) whereby small footprint transformers can be built with significantly improved cooling and reduced temperature rise.

8. A transformer according to claim 3 wherein (a) said transformer having a high voltage winding and a low voltage winding, (b) said high voltage winding positioned on the central portion of said core leg between two groups of said low voltage winding, (c) said high voltage winding connected in two parallel branches with a starting terminal on the center of said high voltage winding and said two branches progressing in both directions from said center terminal toward the two groups of said low voltage winding (d) whereby, for an incoming three phase Y-connected supply line with solidly grounded neutral where each of the three high voltage lines being connected to the center terminal of the respective high voltage winding, winding structures for substantially higher voltages can be built without increased end insulation.

9. A transformer according to claim 2 further including (a) means for accommodating at least two dissipator layers between the same two transfer surfaces of said winding structure.

10. A transformer according to claim 3 characterized by (a) a low voltage helical winding structure comprising substantially plane ring-like sheet metal turns each cut open at a selected radius and connected to the next cut-open turn for building a helical winding.

11. A transformer according to claim 3 characterized by (a) a low voltage helical winding structure comprising a number of parallel sheet metal conductors, equalized by cyclically crossing said conductors (b) whereby each parallel conductor carries substantially equal current.

12. A transformer according to claim 3 wherein (a) a low voltage winding structure comprising a number of substantially plane sheet metal conductors, and (b) a louver-like structure prefabricated on an extended portion of at least one selected conductor, closely adjacent said outer marginal edge of said winding and extending beyond said edge, (c) said louver-like structure including fin means spaced apart from the plane of said conductor (d) whereby savings in material and a reduction of the internal temperature gradient is achieved.

13. A transformer according to claim 1 wherein (a) a core structure constructed from building blocks of steel lamination stacked to have equal height and assembled with butt joints, said blocks alternating with at least one tie sheet placed between subsequent levels of assembled blocks and extended to bridge said butt joints, and (b) at least the shorter blocks of said stacked core provided with adhesive means for converting said blocks into solid objects, and (c) said core structure having at least one generally rectangular window, having a proportion between the longer and the shorter side of said window between 1:1 and 1:1.5

(d) whereby a lighter core structure being built generating smaller losses, lower exciting current and noise level, and requiring significantly reduced labor time.

14. A power transformer exposed to a flow of gaseous or liquid cooling medium having improved heat dissipation characteristics by convection and comprising at least one core leg defining an axis of orientation, and at least one winding structure assembled from coil discs each having an outer marginal edge and at least one substantially plane radial heat transfer surface, said coil discs of said winding structure being adjacent and stacked in axial relation along said core leg, said winding structure warming up through energy losses generated by currents flowing through said winding structure, the improvement comprising:

(a) heat dissipator means of the type including at least one layer of non-magnetizable highly heat conductive material inserted between said coil discs, having at least one substantially plane contact surface defining a first plane, (b) means for establishing tight mechanical contact and improved heat conductive relationship between said contact surface and said transfer surface for receiving heat from said coil discs, (c) said layer including at least one extended portion closely adjacent and extending beyond said outer marginal edge, (d) said extended portion comprising a louver-like structure for transferring heat between said contact surface and said cooling medium, (e) said louver-like structure comprising a multiplicity of substantially parallel fin means defining a central axis for each fin means extending through the center of each, (f) said fin means created by subdividing at least one portion of said extension means along substantially parallel lines, said fin means having two substantially parallel main surfaces on opposed sides, two edge surfaces at a leading and a trailing edge with reference to the flow of said cooling medium, and having a distance between said edges less than twelve times the thickness of said layer, (g) said fin means are arranged sequentially in two sets, a first set and a second set, and the number of said fin means included in said first set is larger by one than the number of said fin means included in said second set, and said fin means in both sets being partitioned from said layer sequentially and spaced apart from each other in the same sequence and with a distance not less than the thickness of said layer, and each set being arranged generally symmetrically with reference to said first plane on both side of said first plane, each set starting on the same side, repeating the displacement of said fin means in the same sequence, alternating said two sets along in least one portion of said louver-like structure in the same manner, (h) each fin means in at least one of said sets being rotated on their central axis into an angular deviation of less than go degrees with reference to said first plane (i) whereby providing sufficiently enlarged channels between narrow fin means, significantly speeding up the flow of the cooling medium by reducing the resistance to the flow, inducing enhanced heat transfer.

15. A transformer according to claim 13 wherein (a) at least two of said core legs having generally horizontal axis of orientation and each core leg accommodating at least one winding structure, and (b) winding structures on said first core leg being superimposed over winding structures on at least one other core leg in vertical relation for creating a small footprint transformer (c) whereby the floor space requirement of said transformer is reduced.

16. A transformer according to claim 13 wherein (a) at least two core legs having generally vertical axis of orientation and each core leg accommodating at least one winding structure, (b) winding structures on said first core leg being superimposed over winding structures on at least one other core leg in vertical relation for creating a small footprint transformer, (c) the contact surfaces of said dissipator means engaging substantially horizontal transfer surfaces having substantially horizontal louver-like structures extending into the entire area available around said transformer (d) whereby, due to the maximum contacting area of the dissipators both internally to the discs and externally to the cooling medium, both internal and external temperature gradients and floor space requirements are reduced.

* * * * *